US005376905A

United States Patent [19]

Kich

[11] Patent Number: 5,376,905

[45] Date of Patent: Dec. 27, 1994

[54] ROTARY VANE VARIABLE POWER DIVIDER

[75] Inventor: Rolf Kich, Redondo Beach, Calif.

[73] Assignee: Hughes Aircraft Company, Los Angeles, Calif.

[21] Appl. No.: 110,604

[22] Filed: Aug. 23, 1993

[51] Int. Cl.[5] ..... H01P 5/16

[52] U.S. Cl. ..... 333/137; 333/21 A; 333/159

[58] Field of Search ..... 333/125, 137, 21 A, 333/157, 159

[56] References Cited

U.S. PATENT DOCUMENTS

| | | | |
|---|---|---|---|
| 2,606,248 | 8/1952 | Dicke | 333/21 A X |
| 3,668,567 | 6/1972 | Rosen | 333/21 A |
| 4,721,930 | 1/1988 | Cohen | 333/137 |
| 4,755,777 | 7/1988 | Cohen et al. | 333/137 |

FOREIGN PATENT DOCUMENTS

| | | | |
|---|---|---|---|
| 832530 | 4/1960 | United Kingdom | 333/159 |

*Primary Examiner*—Paul Gensler

*Attorney, Agent, or Firm*—Terje Gudmestad; Wanda K. Denson-Low

[57] ABSTRACT

A power divider (20) includes two orthomode tee to cylindrical waveguide adapters (26, 34) coupled by a phase shift unit (48) having a slow-wave structure (68) located in a sidewall (82) of a waveguide section (50) at a position located 45 degrees between planes of rectangular ports of the adapters. The slow-wave structure includes a set of vanes (54) which are movable by means of a motor (58) to adjust their penetration through the sidewall of the waveguide section. Adjustment of the penetration provides for selection of an amount of differential phase lag introduced between components of electromagnetic waves propagating through the waveguide section between the two adapters. Pins (96) are formed integrally with the vanes by a notching of edge regions of the vanes. The pins introduce a relatively small amount of phase shift as compared to that introduced by the vanes. However, the phase dispersion of the pins counteracts a phase dispersion of the vanes for increased bandwidth of the power divider. Adjustment of the phase shift provides for rotation of an electric vector for switching an exit point of an electromagnetic wave between either one of two output ports (30, 32) or for a division among the two output ports in any desired average power ratio.

15 Claims, 4 Drawing Sheets

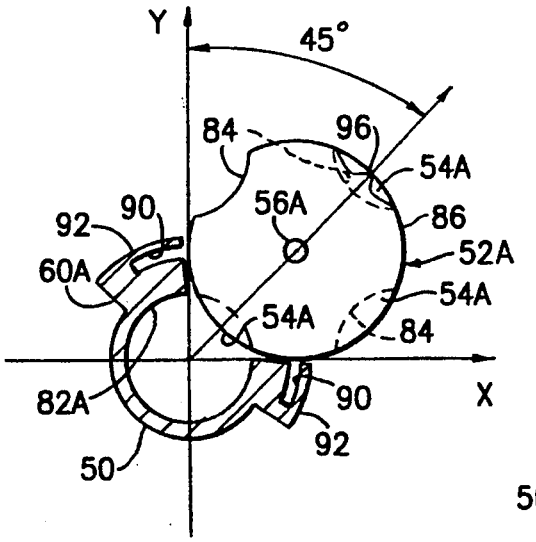
FIG. 6
FIG. 5
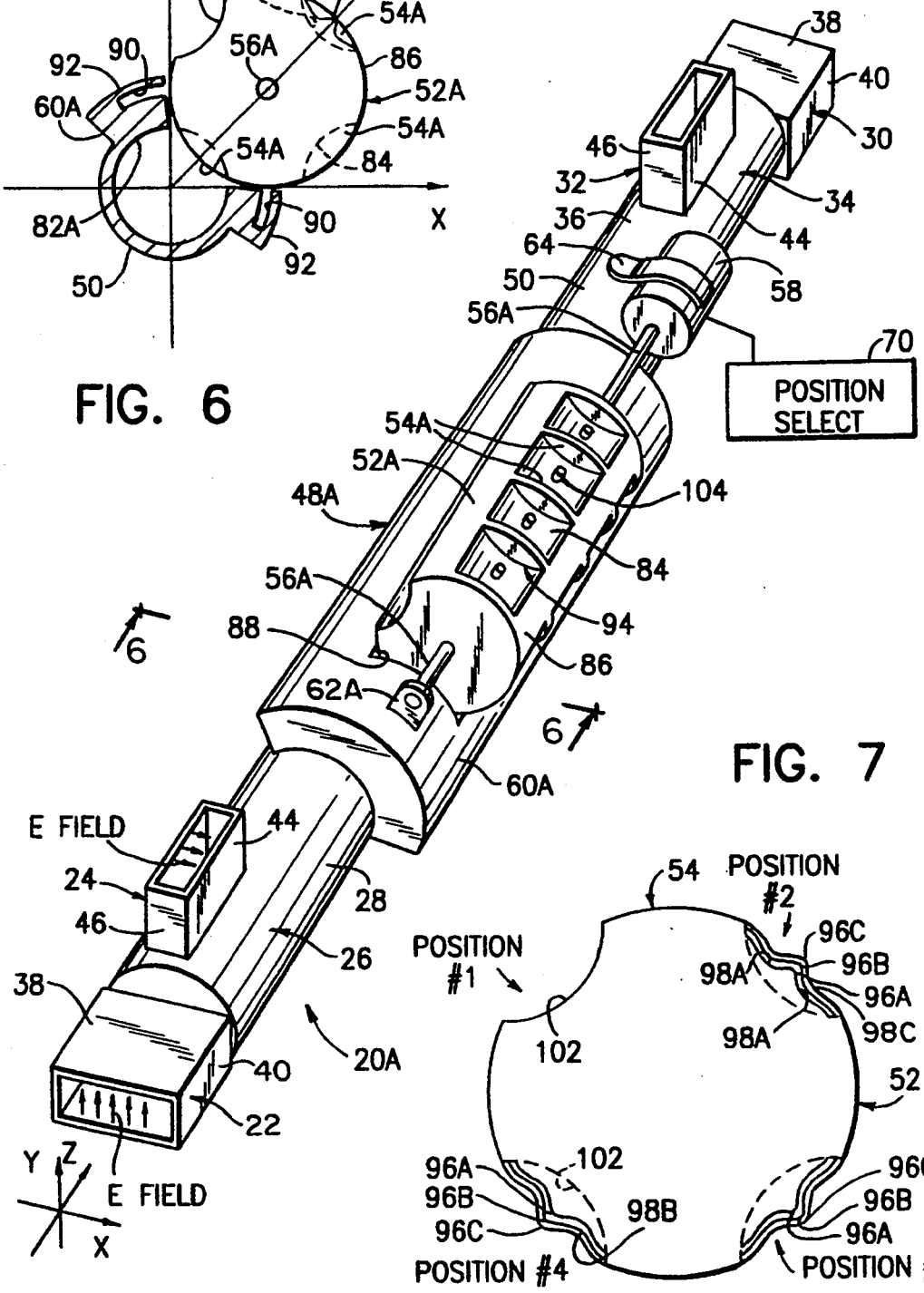
FIG. 7

ROTARY VANE VARIABLE POWER DIVIDER

BACKGROUND OF THE INVENTION

This invention relates to an electromagnetic power divider and, more particularly, to a power divider configured as a cylindrical waveguide interconnecting two orthomode couplers, and having a movable vane slow-wave structure disposed in a sidewall of the cylindrical waveguide with pins in the vanes to broaden a frequency pass band of the power divider.

One form of microwave circuit of interest herein provides for a switching of power from any one of two input ports to any one of two output ports, as well as dividing the power of either of the two input ports among the two output ports. The circuit is to operate also in reciprocal fashion to enable a combining of power received at the two output ports to exit one of the input ports.

A problem arises in that previous attempts to provide these functions have resulted in an undesirably narrow bandwidth, as well as excessive mechanical complexity in the provision of movement among mechanical elements.

SUMMARY OF THE INVENTION

The aforementioned problem is overcome and other advantages are provided, in accordance with the invention, by a microwave power divider having two input ports and two output ports which are connected by a circular cylindrical waveguide having a variable slow-wave structure. The slow-wave structure is angled by 45 degrees relative to an electric field of a TE propagating in the circular waveguide so as to introduce a relative delay between two orthogonal components of the electric field. There results a change in the orientation of the electric field by rotation of the electric field vector about a central axis of the circular waveguide. The two input ports are provided by an input orthomode tee to cylindrical waveguide adapter, and a similar output adapter provides the two output ports.

The construction of the power divider can be visualized with the aid of an orthogonal XYZ coordinate system wherein the Z axis coincides with the longitudinal central axis of the circular waveguide. Each orthomode tee has a first port, and a second port which is perpendicular to the first port. The first port of the input adapter is coplanar with the first port of the output adapter to provide a vertical electric field lying in the YZ plane. The second port of the input adapter is coplanar with the second port of the output adapter to provide a horizontal electric field which lies in the XZ plane. The terms vertical and horizontal, as applied to electric fields herein, are understood to refer to orientation of the electric field relative to a waveguide, and not relative to the earth since the microwave circuit may have any orientation relative to the earth. The aforementioned rotation of the electric field vector allows for selective division of power among the two output ports such that, for a vertical polarization, all of the power exits the first output port, while for a horizontal polarization, all of the power exits the second output port. For a polarization at 45 degrees, or circular polarization, the average power is split equally between the two output ports. Other power division ratios are provided by other amounts of rotation of the electric field vector.

In accordance with a feature of the invention, the slow-wave structure is provided by a series of electrically conductive vanes or fins which protrude slightly, less than one-tenth of a wavelength, through the sidewall of the circular waveguide. The amount of phase shift introduced by the slow-wave structure increases with increased protrusion of the vane into the waveguide, and decreases with decreased protrusion of the vanes into the waveguide. The effect of the vanes upon a wave propagating in the circular waveguide, with respect to the amount of phase shift introduced into the wave, decreases with increasing frequency. Accordingly, in accordance with a further feature of the invention, pins are formed on the vanes by means of notches cut into the vanes, the pins providing the reverse effect on the propagating wave to introduce an increased amount of phase shift with increasing frequency. Thus, the frequency dispersive effect of the vanes is counterbalanced by the frequency dispersive effect of the pins to provide an important advantage wherein the phase shift introduced by the slow-wave structure is constant over a much wider frequency band than has been obtainable heretofore. Each of the vanes is oriented transversely to the Z axis in a plane parallel to the XY plane, and the vanes are spaced apart by one-quarter of a guide wavelength.

In accordance with yet another feature of the invention, means are provided for altering the amount of protrusion of the vanes into the circular waveguide. In a preferred embodiment of the invention, the vanes are connected in a unitary structure, as by mounting all the vanes upon a common rotatable shaft, or by forming the vanes in sections upon a rotatable drum. In a first embodiment of the invention, the vanes are formed as disks which protrude via sidewall apertures into the circular waveguide, the protruding portion interacting with a wave propagating in the waveguide. Along the perimeter of a disk-shaped vane, there are four wave interaction regions. In a second embodiment of the invention, the wave-interaction portions of each vane are mounted to the drum. Thereby, selection of a wave-interaction vane region for each for each of the vanes is accomplished by rotation of the shaft or the drum to select a desired amount of protrusion into the circular waveguide.

Furthermore, in either embodiment, the rotatable vane assembly is supported for rotation about an axis located externally to the circular waveguide so as to avoid emplacement of unnecessary mechanical objects within the circular waveguide, as well as to facilitate implementation of a mechanical drive to provide the rotation. Electromagnetic radiation traps or chokes are disposed on both sides of each vane disk to inhibit leakage of radiant energy via openings in the sidewall through which the vanes protrude. In the case of the drum structure, a single large opening is provided in the sidewall, and an array of chokes is provided abut a perimeter of the opening.

BRIEF DESCRIPTION OF THE DRAWING

The aforementioned aspects and other features of the invention are explained in the following description, taken in connection with the accompanying drawing, wherein:

FIG. 5 is a stylized perspective view of the power divider in accordance with a second embodiment of the invention;

FIG. 6 is a fragmentary sectional view of the power divider taken along the line 6—6 in FIG. 5;

FIG. 7 is a diagrammatic plan view showing a superposition of a plurality of vanes employed in the embodiment of FIG. 1;

DETAILED DESCRIPTION

Figures 1, 2, 3:
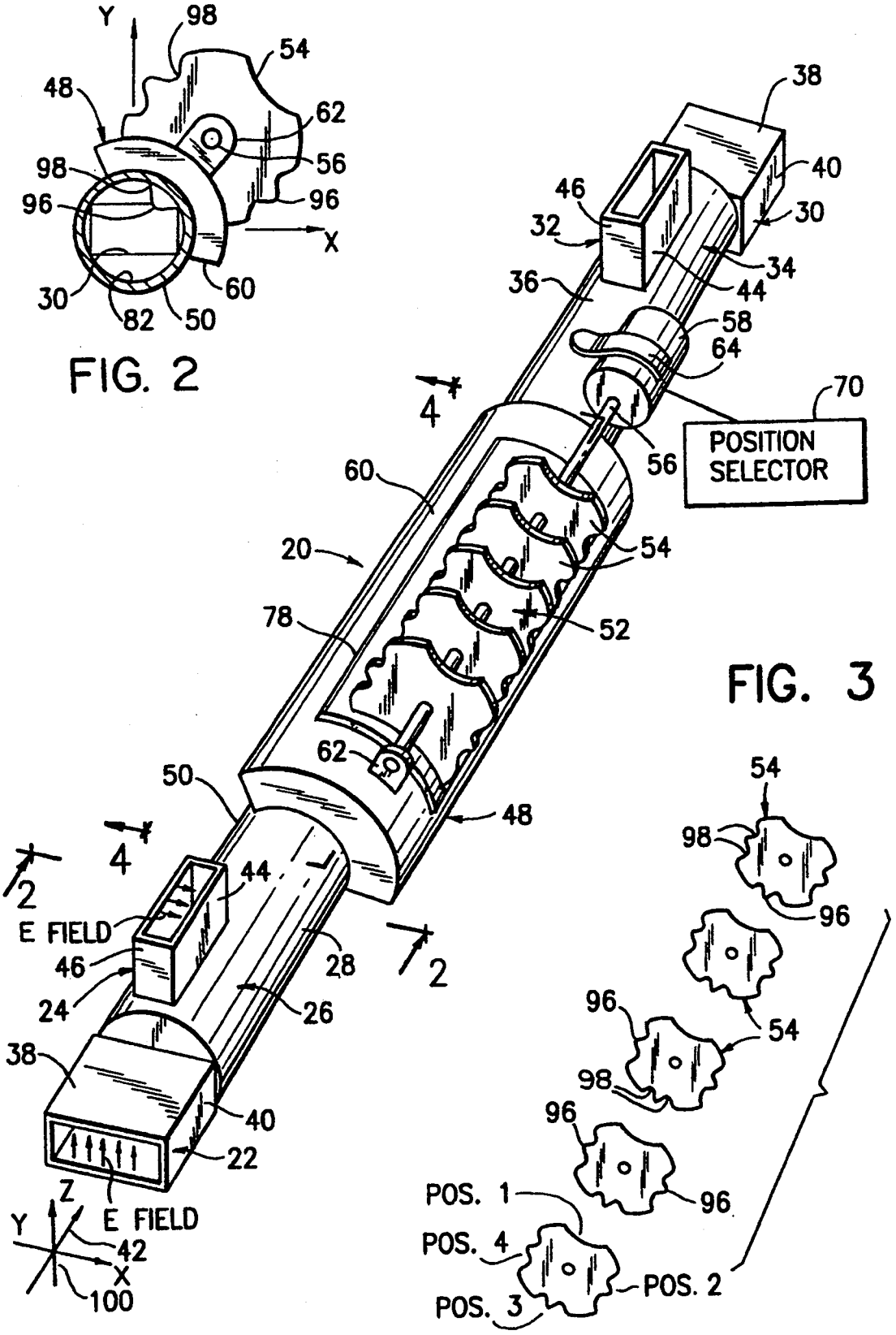
FIG. 1 is a stylized perspective view of a power divider constructed in accordance with a first embodiment of the invention.
FIG. 2 is a fragmentary sectional view of the power divider taken along the line 2—2 of FIG. 1.
FIG. 3 is a set of plan views, partially stylized, of a set of vanes forming a part of the power divider of FIG. 1.

With reference to FIGS. 1–4, there is shown a power divider 20 constructed in accordance with a first embodiment of the invention. The power divider 20 comprises a first input port 22 and a second input port 24 each of which is configured as a section of rectangular waveguide, the two input ports 22 and 24 being part of an input adapter 26 which includes also a section of cylindrical waveguide 28. The input adapter 26 is a well-known form of adapter referred to as an ortho-mode tee to cylindrical waveguide adapter.

The power divider 20 further comprises a first output port 30 and a second output port 32 each of which is configured as a section of rectangular waveguide, the two output ports 30 and 32 being part of an output adapter 34 which includes also a section of cylindrical waveguide 36. The output adapter 34 is also an ortho-mode tee to cylindrical waveguide adapter functioning in the same fashion as the input adapter 26.

The first input port 22 and the first output port 30 each comprise a pair of opposed broad sidewalls 38 and a pair of opposed narrow sidewalls 40. The first input port 22 is coaxial with the first output port 30 about a common axis 42, and their respective broad sidewalls 38 are parallel to each other. In similar fashion, the second input port 24 and the second output port 32 each comprise a pair of opposed broad sidewalls 44 and a pair of opposed narrow sidewalls 46. The broad sidewalls 44 and the narrow sidewalls 46 of the second input port 24 are parallel to the corresponding broad sidewalls 44 and narrow sidewalls 46 of the second output port 32. A central axis of the second input port 24 is perpendicular to the axis 42 and, similarly, a central axis of the second output port 32 is perpendicular to the axis 42. The broad sidewalls 44 of the second input port 24 are parallel to the narrow sidewalls 40 of the first input port 22 and, similarly, the broad sidewalls 44 of the second output port 32 are parallel to the narrow sidewalls 40 of the first output port 30. The waveguide sections 28 and 36 have circular cross section and are equal in diameter.

In accordance with the invention, the waveguide sections 28 and 36 are joined by a phase shift unit 48 comprising a cylindrical waveguide section 50 of circular cross section and having a diameter equal to the diameters of the waveguide sections 28 and 36. The phase shift unit 48 comprises a vane assembly 52 having a set of vanes 54 disposed for rotation about a shaft 56 wherein rotation of the vanes 54 is accomplished by employing an electric motor 58 to rotate the shaft 56. By way of example, in the construction of a preferred embodiment of the invention, there are five vanes 54; however, if desired, more vanes, such as six or seven vanes may be employed, or fewer vanes, such as four vanes, may be employed if desired. Included within the vane assembly 52 is a housing 60 disposed contiguous to the waveguide section 50. A tab 62 extends outward from the housing 60 for supporting one end of the shaft 56, while the opposite end of a shaft 56 is held by the motor 58, the motor 58 being secured by a bracket 64 to the waveguide section 50. The housing 60 comprises a plurality of elongated slot-like openings 66 allowing for passage of the vanes 54 through the housing 60 to the interior of the waveguide section 50. The number of openings 66 is equal to the number of vanes 54, and each vane 54 passes through one of the openings 66.

In accordance with a feature of the invention, the presence of a peripheral portion of each vane 54 within the waveguide section 50 constitutes a slow-wave structure 68 which interacts with an electromagnetic wave propagating through the waveguide section 50 in a manner to be described hereinafter. The amount of interaction depends on the extent of protrusion of each of the vanes 54 into the waveguide section 50 such that a greater protrusion introduces a greater interaction in the form of an increased phase shift, while a lesser protrusion introduces a lesser interaction in the form of a reduced amount of phase shift. It has been found empirically that the amount of protrusion is to be measured in terms of the area (as viewed along the axis of the waveguide section 50 of FIG. 2) of the portion of the vane 54 which protrudes into the waveguide section 50. For example, two protruding portions of different shapes may introduce equal amounts of phase shift if they have substantially the same areas.

By way of example in the construction of the preferred embodiment of the invention, the periphery of each vane 54 is divided into four portions (FIG. 3). If desired, the vanes 54 can be divided into more portions, such as five portions, or less portions, such as three portions (not shown). The various portions are configured to provide for differing amounts of protrusion of the vanes 54 into the waveguide section 50. Thereby, upon rotation of the vanes 54, a different amount of protrusion, and hence interaction with the electromagnetic wave in the waveguide section 50, can be attained. By way of example, the electric motor 58 can be constructed as a stepping motor, and electrical drive circuitry for the stepping motor 58, shown as a position selector 70, is operative to command the motor 58 to rotate the vanes 54 to the desired position, such as any one of the four positions indicated in FIG. 3. In the first position, each of the vanes 54 is cut back sufficiently so as to provide zero protrusion into the waveguide section 50, thereby to avoid introduction of the phase shift to the wave propagating in the waveguide section 50. The second, the third, and the fourth of the position of the vanes 54 introduce successively more protrusion of the vanes 54 into the waveguide section 50 for introduction of successively greater amounts of phase shift to the wave propagating in the waveguide section 50.

In the construction of the phase shift unit 48, the housing 60 and the waveguide section 50 may be fabricated as a unitary structure. For example, the housing 60 and the waveguide section 50 may be formed by milling a single block of electrically conductive material, such as aluminum, or copper. The openings 66 are made slightly larger than the width of the vanes 54 so as to provide for clearance between the housing 60 and the vanes 54 to permit rotation of the vanes 54 within the openings 66. In order to prevent leakage of electromagnetic power from within the waveguide section 50 through the openings 66 to the external environment, a plurality of chokes 72 (FIG. 4) is formed within the housing 60 with one choke 72 being located on each side of a vane 54 and communicating with the opening 66. In order to reduce the amount of space occupied by each choke 72 within the housing 60, each of the chokes 72 is configured with two perpendicular legs 74 and 76, shown in the sectional view of FIG. 4, wherein the end of the leg 74 is shorted. The sum of the length of the legs 74 and 76 is equal to one-half wavelength of the radiation in the waveguide section 50 so as to reflect the short circuit at the end of the leg 74 to a short circuit at the interface of a vane 54 at an opening 66 so as to reflect any radiation which may be present within the opening 66 back into the waveguide section 50.

The chokes 72 are fabricated conveniently by milling the legs 74 and 76 as a cavity within the housing 60, and then by closing off the cavity with a cover plate 78, the cover plate 78 being held by screws 80 to the housing 60. Each opening 66 within the housing 60 extends through the cover plate 78 to provide passage for each vane 54. The cover plate 78 is made of electrically conductive material, such as aluminum or copper, and closes off the aforementioned cavities within the housing 60 to complete the legs 74 and 76 of the respective chokes 72. In the retracted position of the vanes 54, the edges of the vanes 54 are flush with the interior surface of a sidewall 82 of the waveguide section 50.

With reference to FIGS. 5 and 6, there is shown a power divider 20A which is an alternative embodiment of the power divider 20 disclosed in FIGS. 1–4. The power divider 20A has the same structure as the power divider 20, except for a replacement of the phase shift unit 48 (FIGS. 1–4) with a phase shift unit 48A (FIGS. 5 and 6) in the power divider 20A. The phase shift unit 48A comprises a housing 60A and a vane assembly 52A. The vane assembly 52A comprises a set of vanes 54A which are configured as arcuate ribs extending transversely within elongated cylindrical troughs 84 disposed in the outer surface of a drum 86. The drum 86 has an elongated circular cylindrical shape except for the regions of the troughs 84. The drum 86 is rotatable about a shaft 56A driven by a motor 58 in the same fashion as has been described for the previous embodiment of FIGS. 1–4. In FIG. 5, one end of the shaft 56A is supported by a tab 62A, and the opposite end of the shaft 56A is supported by the motor 58, the motor 58 being secured by a bracket 64 to the waveguide section 50. Each trough 84 has a cylindrical surface which constitutes a portion of a circular cylindrical surface of the same diameter as the interior cylindrical surface of the waveguide section 50.

The drum 86 passes through an opening 88 in the housing 60A so as to bring the vanes 54A into the waveguide section 50 upon rotation of the drum 86. At each of four positions of the drum 86, the cylindrical surface of a trough 84 is aligned with the interior cylindrical surface of the waveguide section 50 so as to provide a continuum of a sidewall 82A of the waveguide section 50. A set of chokes 90 are disposed around peripheral regions of the opening 88 to inhibit leakage of radiation from within the waveguide section 50, the chokes 90 operating in a manner analogous to that disclosed previously for the chokes 72 (FIGS. 1–4). Construction of the chokes 90 (FIGS. 5–6) is similar to the construction of the chokes 72, the chokes 90 being formed by cavities within the housing 60A with the cavities being closed off by a metallic plate 92. The vanes 54A are arranged side-by-side in an array extending in the axial direction of the drum 86 to constitute a slow-wave structure 94 which has the same physical configuration as the slow-wave structure 68 (FIG. 4) and is functionally equivalent to the slow-wave structure 68.

Figure 4:
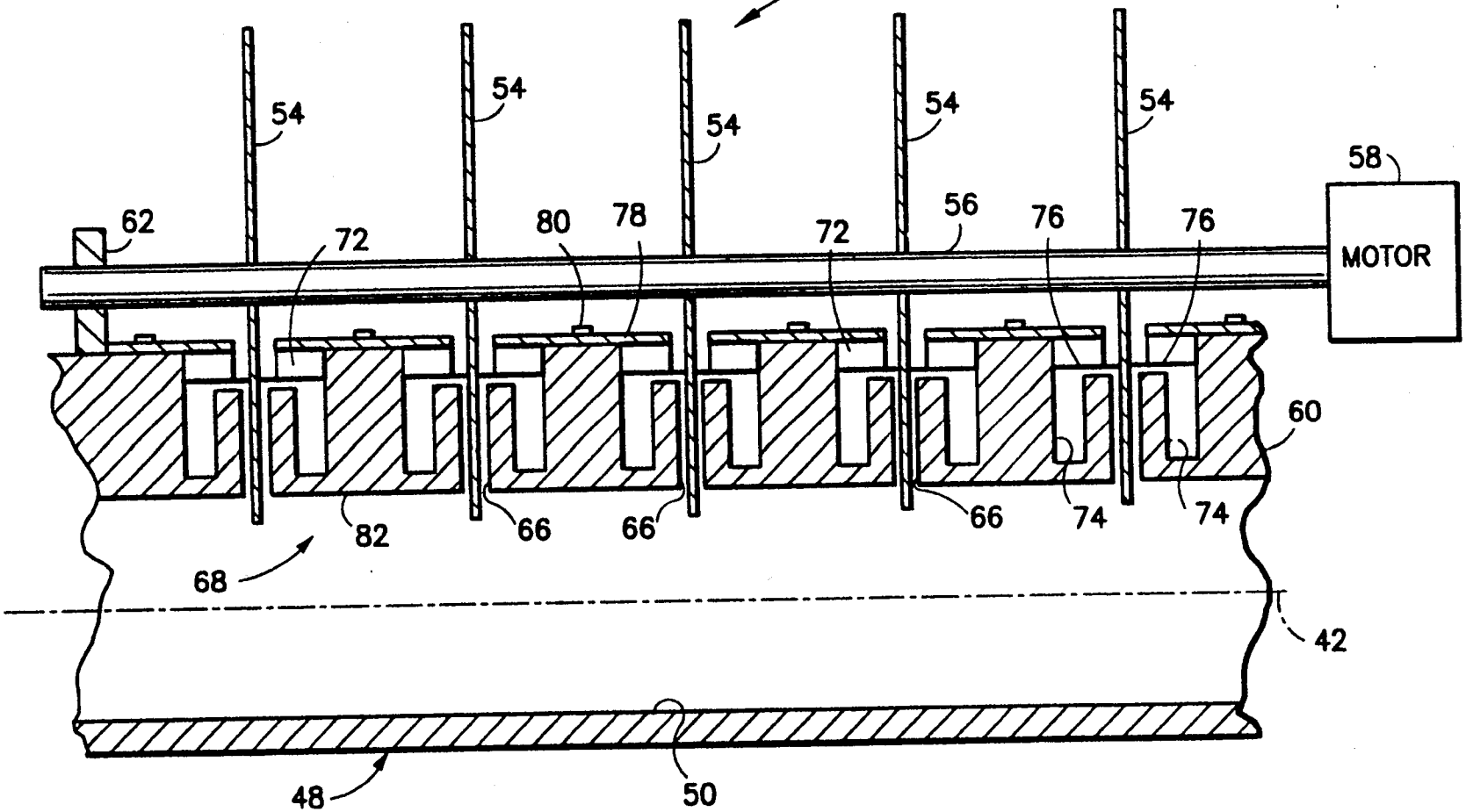
FIG. 4 is a sectional view of the power divider taken along the line 4—4 in FIG. 1.

FIGS. 3 and 7 show pins 96 which are operative, in accordance with a further feature of the invention, to broaden the frequency passband of the slow-wave structure 68 (FIG. 4). As noted hereinabove, the series of vanes 54 in the slow-wave structure 68 introduce a phase shift to radiation propagating along the waveguide section 50. As shown in FIG. 3, the pins 96 are formed in respective ones of the vanes 54 by cutting notches 98 in each of the vanes 54. A pin 96 represents the furthest extent of protrusion of a vane 54 into the waveguide section 50, as shown in FIG. 2. A center line of the pin 96 is oriented at 45 degrees relative to the X and to the Y axes of the XYZ orthogonal coordinate system 100 (FIGS. 1 and 2). The effect of the pins 96 is to increase the amount of phase shift as a function of increasing frequency, thereby to counteract the effect of the vanes 54 which tend to decrease the amount of phase shift as a function of increasing frequency.

With respect to the five vanes 54 depicted in FIG. 3, the pins 96 are the largest for greatest protrusion into the waveguide section 50, and the notches 98 are the deepest in the center one of the five vanes 54. The two end vanes 54 of the series have the smallest pins 96 and the most shallow notches 98, while the second and the fourth of the vanes 54 have pins 96 of intermediate size and notches 98 of intermediate depth. This configuration of the series of vanes 54 provides a smooth transition to waves propagating through the waveguide section 50, and tends to minimize any reflection of a wave propagating through the waveguide section 50. Thus, in FIG. 3, the first and the fifth of the vanes 54 are identical, and the second and the fourth of the vanes 54 are identical.

In FIG. 7, the first three vanes 54 are shown superposed in the diagrammatic presentation of FIG. 7. The pins of the first, the second, and the third of the vanes 54 are indicated as pins 96A, 96B and 96C, respectively. The notches of the vanes 54 are correspondingly identified as notches 98A, 98B, and 98C, respectively, of the first, the second, and the third of the vanes 54. In the first position of the vane assembly 52, there is a cutout portion of each of the vanes 54 in the form of an arc 102 having a radius of curvature equal to that of the sidewall 82 (FIGS., 2 and 4) of the waveguide section 50 so that, in the first position of the vane assembly 52, the phase shift unit 48 presents an electrically smooth surface and no phase shift. The arc 102 is indicated in phantom at the second, the third, and the fourth of the positions of the vane assembly 52 for comparison with the configurations of the portions of the vanes 54 which extend into the waveguide section 50 for interaction with an electromagnetic wave. Thereby, FIG. 7 shows a relatively small protrusion for the vanes 54 in the second position of the vane assembly 52, a larger protrusion of the vanes 54 the third position of the vane assembly 52, and a maximum protrusion of the vanes 54 in the fourth position of the vane assembly 52.

In the alternative embodiment of FIGS. 5 and 6, the slow-wave structure 94 is provided also with tuning screws 104 to supplement the action of the pins 96 for broadening the frequency passband of the slow-wave structure 94. However, in the slow-wave structure 94 of FIGS. 5–6, the screws 104 are positioned directly on the surface of the trough 84 between adjacent ones of the vanes 54A. The protrusion of the various vanes 54A for different positions of the vane assembly 52A is shown in FIG. 6. In the vane assembly 52A, the vane 54A at the center of the series of vanes projects the furthest into the waveguide section 50 while the vanes 54A at the opposite ends of the array of vanes protrude the least amount into the waveguide assembly 50. The second and the fourth of the vanes 54A protrude equally to an intermediate value of protrusion to the waveguide section 50.

Figure 8:
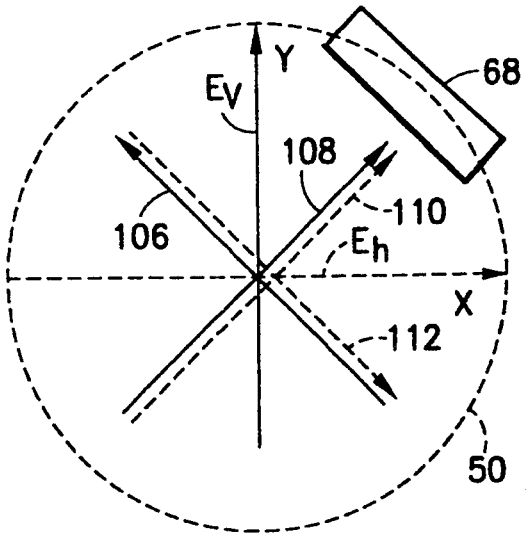
FIG. 8 shows a diagram of vertical and horizontal electric field vectors and their corresponding component parts for selective interaction with a slow-wave structure in the embodiments of FIGS. 1 and 5.
Figure 9:
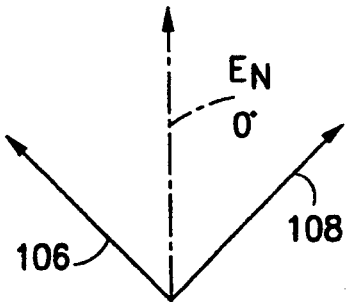
FIG. 9 shows a diagram of the component parts of a vertical electric field vector in the absence of the slow-wave structure.
Figure 10:
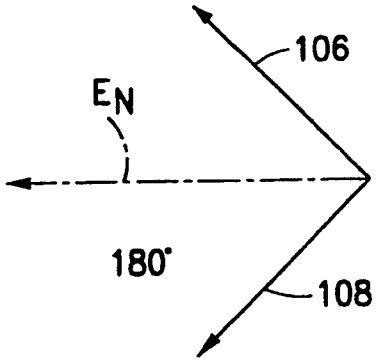
FIG. 10 shows a summation of the component parts of the vertical electric field vector after introducing a relative phase shift of 180 degrees by means of the slow-wave structure.

FIGS. 8–10 explain rotation of the electric field vectors by means of vector diagrams. In FIG. 8, the slow-wave structure 68 is located on the waveguide section 50 at a position 45 degrees between the X an the Y axes. The vertical electric field, $E_v$, provided by the first input port 22, (FIG. 1) and components of the electric field $E_v$ are shown in solid lines, while the horizontal electric field, $E_h$, provided by the second input port 24 (FIG. 1) and components of the electric field $E_h$ are shown with dashed lines. As is well known in the operation of an orthomode tee to cylindrical waveguide adapter, such as the input adapter 26, input transverse electric ($TE_{10}$) waves are applied to the input ports 22 and 24 with the electric field vector extending parallel to the narrow sidewalls 40. Typically, the width of the broad sidewall 38 is twice the width of the narrow sidewall 40, and, similarly, the width of the broad sidewall 44 is twice the width of the narrow sidewall 46. In the second input port 24, the electric field vector is oriented parallel to the narrow sidewalls 46. The two transverse electric waves interact, independently of each other, at the junctions of the rectangular waveguide sections with the cylindrical waveguide section 28 to provide for vertical and horizontally polarized waves propagating in the Z direction towards the output adapter 34 along the axis 42. In the waveguide section 50, the cylindrical transverse electric mode of propagation is the $TE_{11}$ mode of propagation wherein the vertically polarized wave $E_v$ results from the TE wave inputted at the first input port 22 and the horizontal electric field $E_h$ results from the TE wave incident at the second input port 24.

Figure 11:
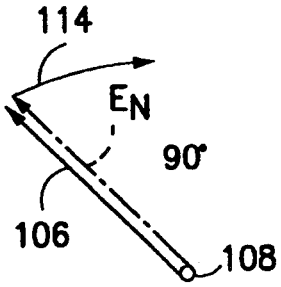
FIG. 11 shows summation of the component parts of the vertical electric field vector after introduction of a relative phase shift of 90 degrees by the slow-wave structure.

The vector $E_v$ has two orthogonal components 106 and 108, and the vector $E_h$ has two orthogonal components 110 and 112. The components 108 and 110 interact with the slow-wave structure 68 to experience a phase lag. With respect to the components of the vertical electric field $E_v$, FIG. 9 shows the situation in which the vanes of the slow-wave structure 68 are fully retracted in which case there is zero phase shift. The two components 106 and 108 combine to produce a resultant electric field $E_r$ directed vertically which is outputted at the first output port 30 (FIG. 1). FIG. 10 shows the situation in which the vanes of the slow-wave structure 68 are fully extended to introduce a phase shift of 180 degrees to the component 108. The two components 106 and 108 sum vectorially to produce a resultant electric field $E_r$ which is directed horizontally to be outputted by the second output port 32. FIG. 11 depicts the situation wherein the vanes of the slow-wave structure 68 are partially extended to introduce a phase lag of 90 degrees to the component 108. In this situation, the sinusoidally varying amplitude of the component 108 reaches a value of zero when the amplitude of the sinusoidally varying component 106 reaches a maximum value. At that instant of time, as depicted in FIG. 11, the resultant electric field $E_r$ coincides with the component 106. However, as is well known, two orthogonal components which are 90 degrees out of phase produce a circularly polarized wave wherein the resultant vector $E_r$ rotates as indicated by the arrow 114. Due to the rotation of the resultant vector at a constant rate, the average power outputted by the first output port 30 is equal to the average power outputted by the second output port 32.

Thus, the examples of phase shift set forth in FIGS. 9, 10, and 11 describe the situation in which power inputted to the power divider 20 via the first input port 22 can be switched, by use of the phase shift unit 48, to be outputted totally by the first output port 30 (FIG. 9), or to be outputted totally by the second output port 32 (FIG. 10), or to be outputted as equal average power between the two output ports 30 and 32 (FIG. 11). Further switching capacity can be provided, in accordance with the principles of the invention, by configuring the set of vanes 54 to provide, by way of example, only 10 degrees of phase shift to the components 108. In such a situation, the resultant electric field would oscillate about the vertical position, or Y axis, resulting in a major portion of the average power being outputted by the first output port 30 with only a small fraction of average power being outputted by the second output port 32. While the foregoing discussion has been directed to power inputted via the first input port 22, the discussion applies equally well to power inputted via the second input port 24. Also, while the foregoing discussion has been based on the configuration of phase shift unit 48 of FIGS. 1–4, the foregoing principles of operation apply equally well to the use of the phase shift unit 48A of FIGS. 5 and 6. Furthermore, it is noted that the microwave circuitry of the power divider 20, 20A operates in reciprocal fashion to serve as a power combiner and, accordingly, the use of the term "divider" herein is understood to include "combiner".

By way of example in construction of the power divider 20 for operation at Ku band (approximately 12.2–12.7 GHz (gigahertz)), selection of the sizes of the pins 96 for balancing the phase dispersion characteristic of the vanes 54 results in a useful bandwidth of approximately 500 MHz (megahertz). The nominal diameter of each vane 54 is 1.300 inches, and the inside diameter of the waveguide section 50 is 0.686 inches. The separation between the axis of the vane assembly 52 and the waveguide section 50 is 0.786 inch. The width of each slot-shaped opening 66 (FIG. 4) is 0.030 inches, as measured in the direction of the axis 42, and the thickness of a vane 54 is approximately 0.016 inches so as to provide suitable clearance with the edges of the opening 66 to allow for movement of the vane 54. It is to be understood that the foregoing dimensions are given only by way of example, and that the dimensions may be altered to suit a specific application of the invention. The foregoing construction is particularly advantageous because all of the apparatus for movement of the vanes, such as the shaft 56 and the motor 58, are located outside of the waveguide section 50. Also, the foregoing apparatus is readily fabricated by a milling procedure in which the various openings and cavities are milled into the housing 60, 60A, and then the cavities are closed off by a cover plate 78, 92. Thereupon, the vane assembly 52, 52A is attached to the housing 60, 60A to complete construction of the phase shift unit 48, 48A. The spacing from the first opening 66 (or vane 54) to the last opening 66 (or vane 54) is approximately one guide wavelength and the spacing between successive ones of the vanes 54 is approximately one-quarter of a guide wavelength. Approximately 85% of the phase shift is produced by the vanes 54 of the vane assembly 52, with the pins 96 introducing approximately only 15% of the phase shift.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An electromagnetic power divider comprising:

a circular waveguide;

a first input port and a first output port disposed on opposite ends of said waveguide, each of said first ports being operative to couple a vertically polarized wave to said waveguide;

a second input port and a second output port disposed on opposite ends of said waveguide, each of said second ports being operative to couple a horizontally polarized wave to said waveguide;

a slow-wave structure disposed in a sidewall of said waveguide and being oriented along a longitudinal plane of said waveguide, said longitudinal plane being angled relative to a vertical plane of said vertically polarized wave, said slow-wave structure comprising a series of vanes oriented transversely of a longitudinal axis of said waveguide and being spaced apart in a longitudinal direction of said waveguide;

pin means located on said vanes for counteracting a frequency dispersive characteristic of said vanes; and means for operating said vanes to alter configurations of surfaces of the pin means on respective ones of said vanes for selective interaction with an electromagnetic wave propagating in said waveguide.

2. An electromagnetic power divider comprising:

a circular waveguide;

a first input port and a first output port disposed on opposite ends of said waveguide, each of said first ports being operative to couple a vertically polarized wave to said waveguide;

a second input port and a second output port disposed on opposite ends of said waveguide, each of said second ports being operative to couple a horizontally polarized wave to said waveguide;

a slow-wave structure disposed in a sidewall of said waveguide and being oriented along a longitudinal plane of said waveguide, said longitudinal plane being angled relative to a vertical plane of said vertically polarized wave, said slow-wave structure comprising a series of vanes oriented transversely of a longitudinal axis of said waveguide and being spaced apart in a longitudinal direction of said waveguide;

pin means located on said vanes for counteracting a frequency dispersive characteristic of said vanes; and wherein said slow-wave structure serves to introduce phase shift to one of two orthogonal components of an electric field of said vertically polarized wave and of an electric field of said horizontally polarized wave, the amounts of phase shift increasing with protrusion of a vane into said waveguide;

wherein, upon introduction of an electromagnetic wave into said circular waveguide via one of said input ports, an introduction of phase shift via said slow-wave structure is operative to rotate an electric field vector for selecting relative amounts of radiant power to exit respective ones of said output ports; and said power divider further comprises means for selecting a wave-interaction vane region at each of said vanes for interacting with the electromagnetic wave to produce a desired amount of the phase shift.

3. A power divider according to claim 2 wherein said pin means comprises at least one pin disposed in each of said vanes, each pin extending from a respective one of said vanes towards said waveguide axis.

4. A power divider according to claim 3 where in each of said vanes includes notches defining a pin of said pin means.

5. A power divider according to claim 4 wherein said longitudinal plane of said waveguide has an angulation of 45 degrees about said longitudinal axis relative to said vertical plane of said vertically polarized wave.

6. A power divider according to claim 5 wherein said selecting means includes means for rotating each of said vanes into operative position for introduction of a phase shift to an electromagnetic wave in said waveguide.

7. A power divider according to claim 6 wherein each of said vanes comprises a rotatable disk and a plurality of said wave-interaction vane regions disposed on said rotatable disk.

8. A power divider according to claim 7 wherein the disk of each of said vanes rotates about an axis disposed outside of said waveguide, the disk extending through an aperture in a sidewall of said waveguide to interact with an electromagnetic wave propagating in said waveguide; and wherein said selecting means comprises means for rotating each of said disks to insert a desired wave-interaction vane region into said waveguide.

9. A power divider according to claim 8 further comprising radiation choke means disposed about a perimeter of the sidewall aperture for each disk to inhibit radiation leakage from said waveguide.

10. A power divider according to claim 9 wherein the amount of protrusion of a vane into said waveguide establishes an amount of phase shift to be introduced to a wave propagating in said waveguide, individual ones of said plurality of wave-interaction vane regions of respective ones of said vanes differing in an amount of protrusion into said waveguide.

11. A power divider according to claim 2 further comprising a drum extending through a sidewall of said waveguide and, wherein, each of said vanes comprises a plurality of said wave-interaction vane regions disposed on said drum.

12. A power divider according to claim 11 wherein said drum is rotatable about an axis disposed outside of said waveguide, the drum extending through said aperture in the sidewall of said waveguide to interact with an electromagnetic wave propagating in said waveguide; and wherein said selecting means comprises means for rotating said drum to insert a desired wave-interaction vane region into said waveguide.

13. A power divider according to claim 12 further comprising radiation choke means disposed about a perimeter of said sidewall aperture to inhibit radiation leakage from said waveguide.

14. A power divider according to claim 13 wherein, in each of said vanes, the amount of protrusion of a wave-interaction vane region establishes an amount of phase shift to be introduced to a wave propagating in said waveguide, a plurality of wave-interaction vane regions of respective ones of said vanes differing in an amount of protrusion into said waveguide.

15. An electromagnetic power divider comprising:

a circular waveguide;

a first input port and a first output port disposed on opposite ends of said waveguide, each of said first ports being operative to couple a vertically polarized wave to said waveguide;

a second input port and a second output port disposed on opposite ends of said waveguide, each of said second ports being operative to couple a horizontally polarized wave to said waveguide;

a slow-wave structure disposed in a sidewall of said waveguide and being oriented along a longitudinal plane of said waveguide, said longitudinal plane being angled relative to a vertical plane of said vertically polarized wave, said slow-wave structure comprising vane insertion means operative to insert into said waveguide a series of vane elements oriented transversely of a longitudinal axis of said waveguide, said vane elements being spaced apart in a longitudinal direction of said waveguide; and wherein each of said vane elements has a configuration for interaction with an electromagnetic wave propagating in said waveguide, said configuration defining pin means located on said vanes for counteracting a frequency dispersive characteristic of said vane elements; and said vane insertion means are operative to vary the configuration of each of said vane elements.

* * * * *